US007548715B2

(12) United States Patent
Li et al.

(10) Patent No.: US 7,548,715 B2
(45) Date of Patent: Jun. 16, 2009

(54) CONTAINER FOR TONER CARTRIDGE

(75) Inventors: Kuan-Tung Li, Taichung County (TW); Chun-Tien Liu, Taichung County (TW); Yueh-Chun Lee, Taichung County (TW)

(73) Assignee: General Plastic Industrial Co., Ltd., Taichung County (TW)

( * ) Notice: Subject to any disclaimer, the term of this patent is extended or adjusted under 35 U.S.C. 154(b) by 161 days.

(21) Appl. No.: 11/740,373

(22) Filed: Apr. 26, 2007

(65) Prior Publication Data

US 2008/0267670 A1 Oct. 30, 2008

(51) Int. Cl.
*G03G 15/08* (2006.01)

(52) U.S. Cl. ..... 399/263; 399/262; 222/DIG. 1

(58) Field of Classification Search ..... 399/120, 399/258, 262, 263; 222/DIG. 1
See application file for complete search history.

(56) References Cited

U.S. PATENT DOCUMENTS

| | | | | |
|---|---|---|---|---|
| 5,918,090 | A * | 6/1999 | Ichikawa et al. | 399/120 |
| 5,991,584 | A * | 11/1999 | Meyer et al. | 399/262 |
| 2002/0001485 | A1 * | 1/2002 | Ichikawa et al. | 399/262 |
| 2003/0156861 | A1 * | 8/2003 | Nagano et al. | 399/262 |

* cited by examiner

*Primary Examiner*—Timothy J Thompson
*Assistant Examiner*—Gregory H Curran
(74) *Attorney, Agent, or Firm*—Browdy and Neimark, P.L.L.C.

(57) ABSTRACT

A container for a toner cartridge includes a hollow main body defining a longitudinal central axis. The main body has a first section near a rear end thereof, a second section near a front end thereof, a connecting section between the first and second sections, a longitudinal rib extending from the first section to the second section via the connecting section. The radii of cross sections of the first and second sections respectively gradually increase toward the front end of the main body. The longitudinal rib has a third guiding surface defining with the central axis a distance shorter than the radius of a cross section of the connecting section. The container can effectively move the toner accommodated inside the container from the rear end toward the front end. A mold for the container is easy to manufacture, resulting in cost reduction in manufacturing.

8 Claims, 7 Drawing Sheets

CONTAINER FOR TONER CARTRIDGE

BACKGROUND OF THE INVENTION

1. Field of the Invention

The present invention relates generally to a toner cartridge and more specifically, to a container for a toner cartridge, which is easy to manufacture and has low production costs.

2. Description of the Related Art

A conventional toner cartridge is generally horizontally installed in an image forming apparatus, such as photocopier or printer, for discharge of toner. The toner cartridge commonly comprises an elongated hollow container for accommodation of toner, and a toner-guiding member, which is mounted on a front end of the container and provided with an outlet for output of the toner accommodated inside the container. In order to discharge the toner from the container to the image forming apparatus through the outlet, the toner cartridge is provided at an inner circumference thereof with a plurality of spiral ribs, which can force the toner to move from the inside of the container to the outside of the container through the outlet of the toner-guiding member when the toner cartridge is rotated.

Because the toner is forced to move by the spiral ribs, the spiral ribs need to be lined on the whole inner circumference of the container, such that a mold for the container can be difficulty manufactured, resulting in high production costs. Therefore, it is a need to provide an improved container for the toner cartridge.

SUMMARY OF THE INVENTION

The present invention has been accomplished in view of the above noted circumstances. It is therefore one objective of the present invention to provide a container for a toner cartridge, which is easy to manufacture and has low production costs.

To achieve this objective of the present invention, the container comprises an elongated hollow main body defining a central axis. The main body has a rear end and a front end with an opening. The main body further includes a first section near the rear end, a second section near the front end, a connecting section between the first section and the second section, and a longitudinal rib protruding inwardly from an inner circumference of the main body and extending from the first section to the second section via the connecting section. The first section is provided at the inner circumference with a first guiding surface defining with the central axis a distance L1 gradually increasing toward the opening, the second section is provided at the inner circumference with a second guiding surface defining with the central axis a distance L2 gradually increasing toward the opening, the longitudinal rib has a third guiding surface facing the central axis and defining with the central axis a distance L3, and the inner circumference at the connecting section defines with the central axis a distance L4 that is longer than the distance L3 at any cross section of the connecting section.

By means of the aforesaid design, the disclosed container can effectively move the toner accommodated inside the container from the rear end toward the front end when it is rotated about the central axis. In addition, a mold for the container is easy to manufacture, resulting in cost reduction in manufacturing.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
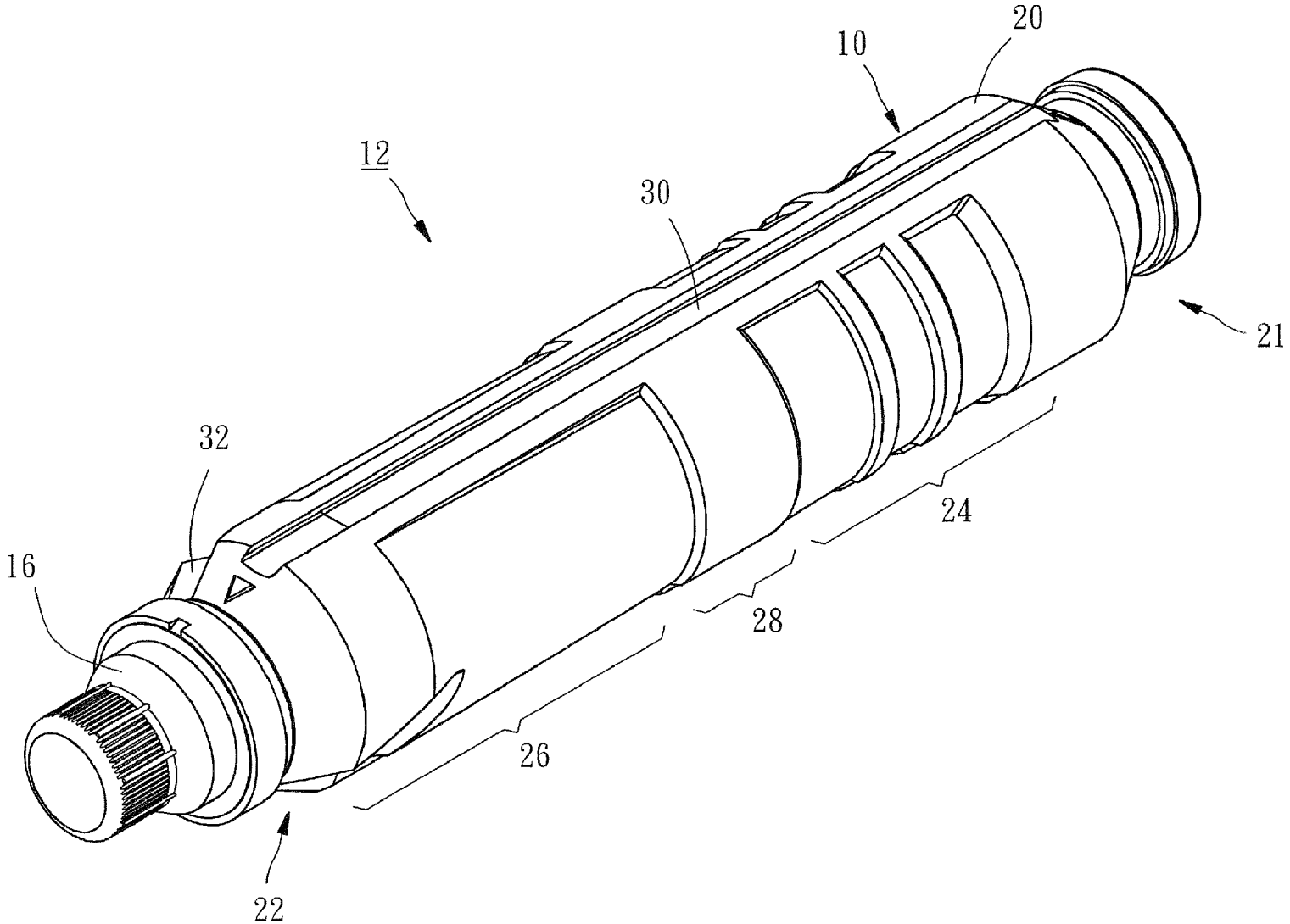
FIG. 1 is a perspective view of a first preferred embodiment of the present invention.
Figure 2:
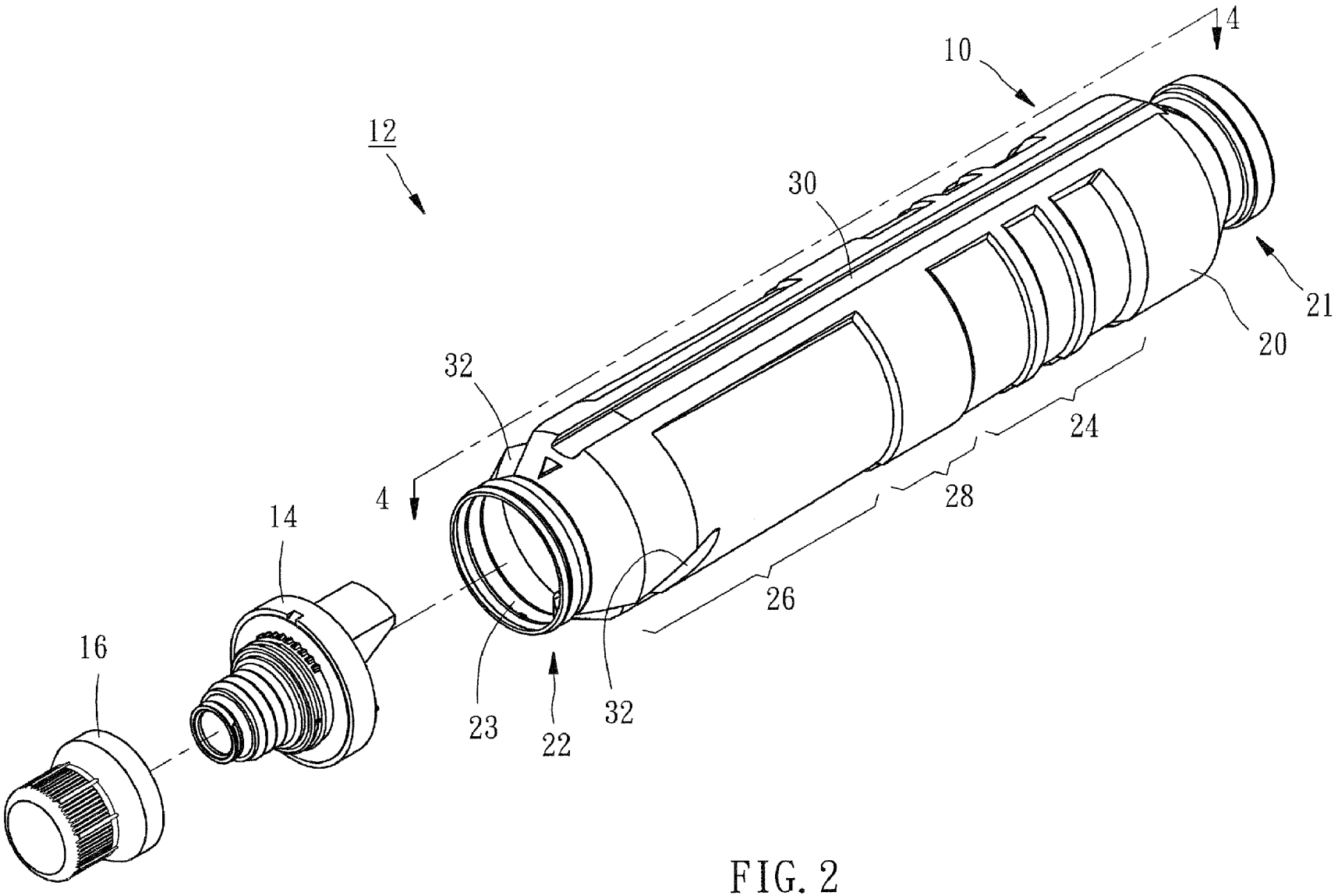
FIG. 2 is an exploded view of the first preferred embodiment of the present invention.

As shown in FIG. 1 and FIG. 2, a container 10 for a toner cartridge 12 in accordance with a first preferred embodiment of the present invention comprises an elongated hollow main body 20 for accommodation of toner. The main body 20 is provided with a rear end 21 and a front end 22 with an opening 23. The toner cartridge 12 includes a toner-guiding member 14 mounted on the front end 22 of the container 10 for guiding the toner out of the container 10, and a lid 16 covered on the toner-guiding member 14 for closing the toner-guiding member 14.

Figure 3:
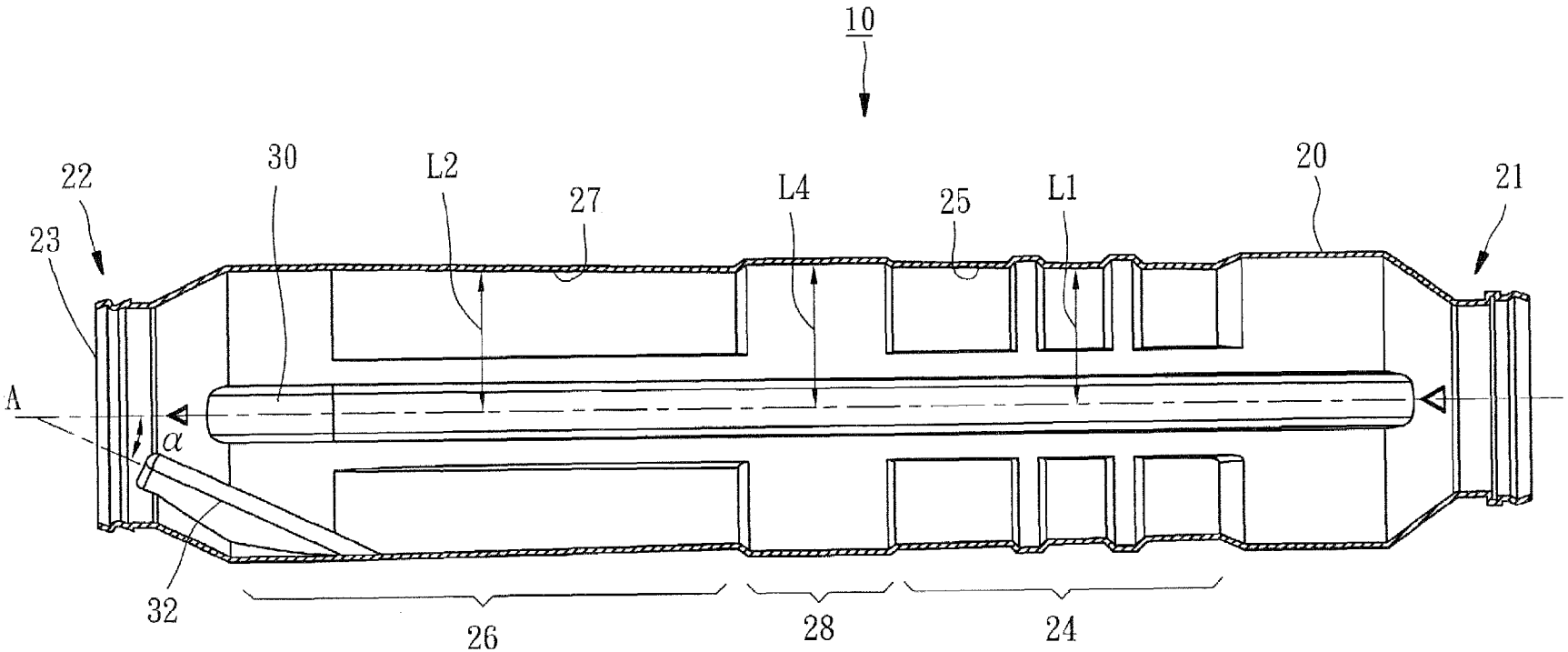
FIG. 3 is a longitudinal sectional view of the first preferred embodiment of the present invention.

The main body 20 extends along a longitudinal central axis A thereof and defines along the axis A three sections, namely a first section 24 near the rear end 21, a second section 26 near the front end 22, and a connecting section 28 integrally connected between the first section 24 and the second section 26. The main body 20 further has a longitudinal rib 30 protruding inwardly from an inner circumference of the main body 20 and extending longitudinally from the first section 24 to the second section 26 via the connecting section 28, and two guiding flaps 32 equiangularly inclinedly protruding inwardly from the inner circumference of the main body 20 and extending from the second section 26 to a position close to the opening 23 in such a manner that each of the guiding flaps 32 and the central axis A are unparallel. As shown in FIG. 3, an included angle of about 30 degrees is defined between each guiding flap 32 and the axis A in this embodiment.

As shown in FIG. 3, the first section 24 defines a first guiding surface 25 at the inner circumference thereof. The distance L1 between the first guiding surface 25 and the central axis A, i.e. the radius measured from the inner circumference of the first section 24 to the central axis A, gradually increases toward the opening 23. In this embodiment, the distance L1 increases from 18 mm to 19 mm toward the opening 23, such that the first guiding surface 25 is formed as a tapered surface, i.e. the first section 24 has substantially a profile in the form of truncated conoid. Similarly, the second section 26 defines at the inner circumference thereof a second guiding surface 27. The distance L2 between the second guiding surface 27 and the central axis A gradually increases toward the opening 23. It increases from 18.5 mm to 19.5 mm toward the opening 23 in this embodiment, such that the second guiding surface 27 is formed as a tapered surface. The distance L4 between the inner circumference at the connecting section 28 and the axis A is a fixed value and equal to 20 mm in this embodiment, i.e. the distance L4 is longer than both of the distance L1 and distance L2.

Figure 4:
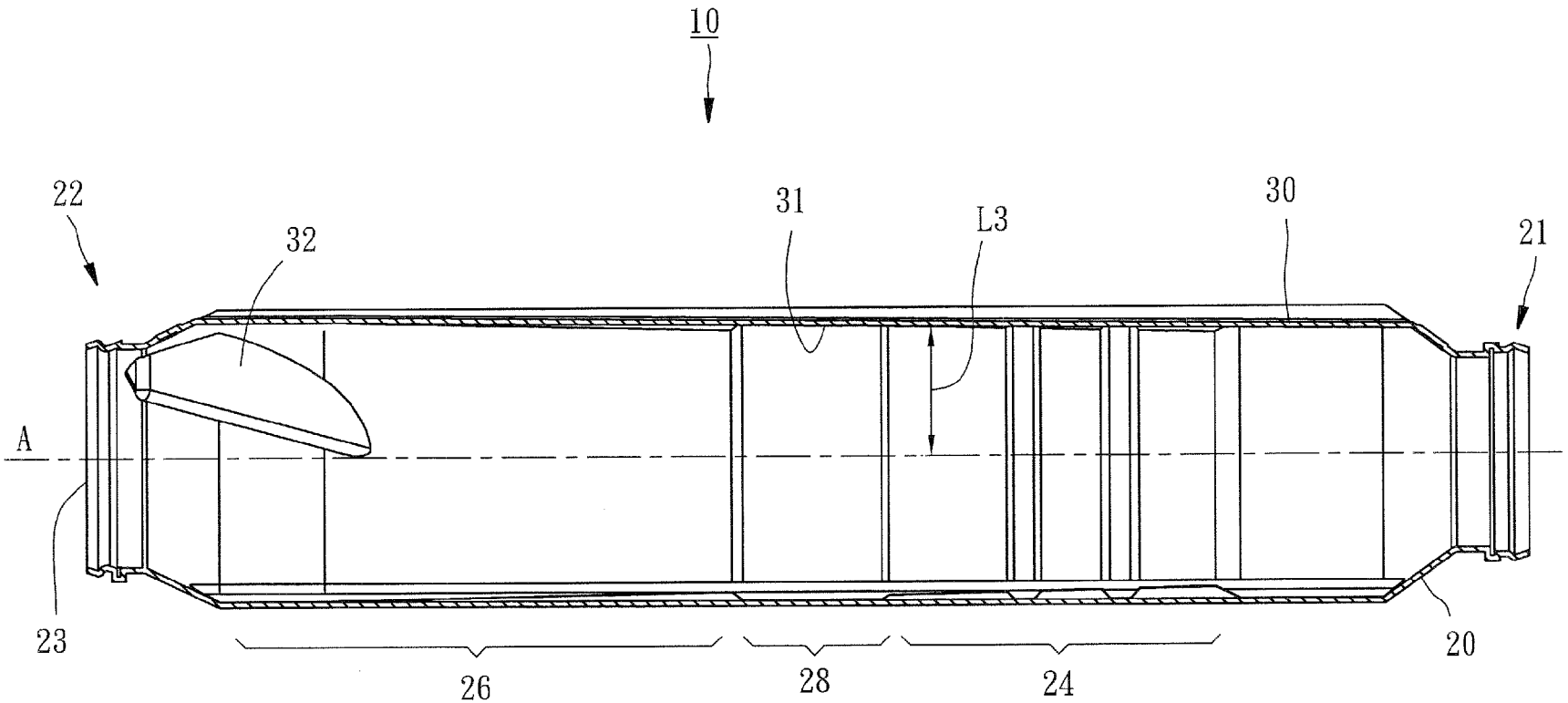
FIG. 4 is a sectional view taken along line 4-4 of FIG. 2.
Figure 5:
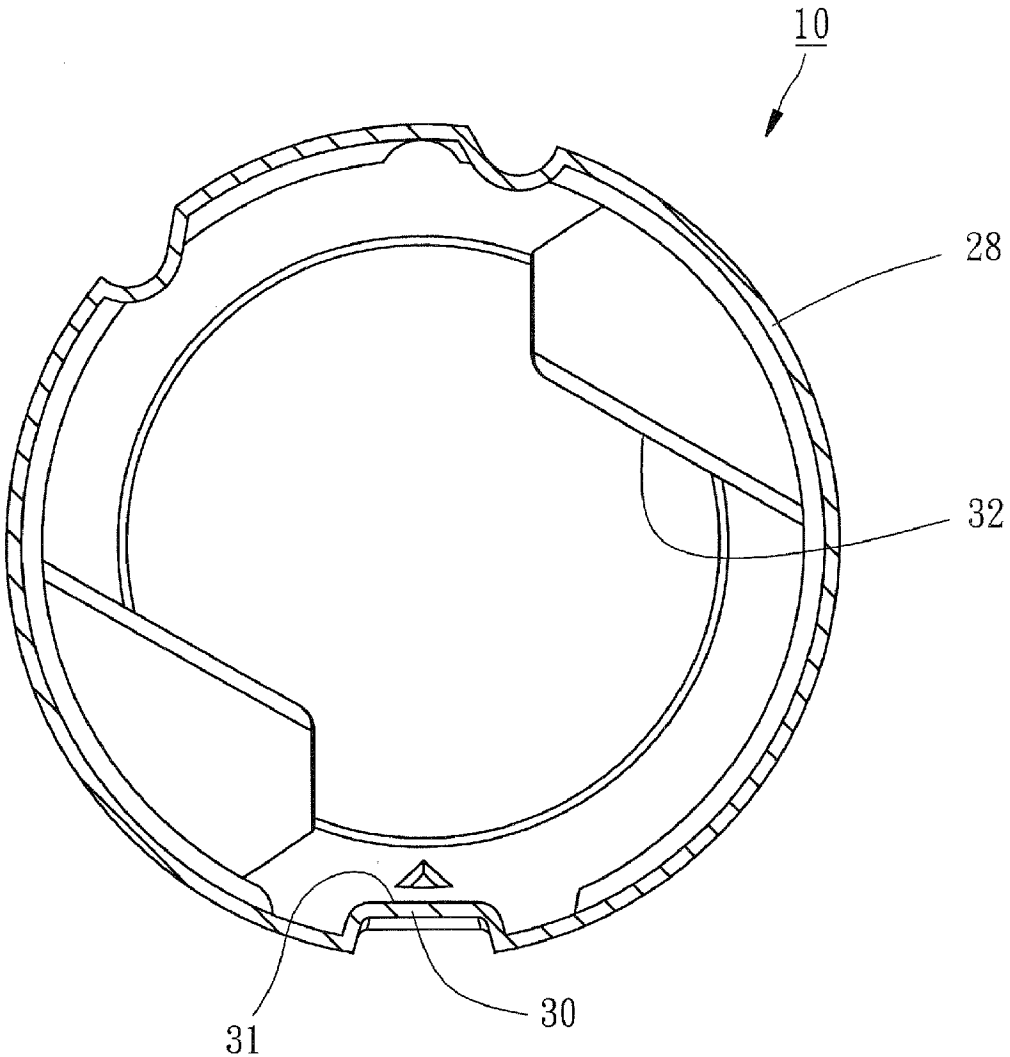
FIG. 5 is a cross-sectional view of the connecting section of the first preferred embodiment of the present invention.

Referring to FIG. 4, the longitudinal rib 30 has a third guiding surface 31 facing the central axis A and defining with the central axis A a distance L3, which gradually increases toward the opening 23. In this embodiment, the distance L3 increases from 15.5 mm to 18 mm. Consequently, the distance L3 is shorter than the distance L2 at any cross section of the second section 26 and shorter than the distance L4 at any cross section of the connecting section 28 and also shorter than the distance L1 at any cross section of the first section 24.

When the toner cartridge 12 is horizontally installed in an image forming apparatus and rotated about the central axis A, the toner in the container 10 will naturally move by the gravity from the rear end portion of the first section 24 to the front end portion of the first section 24 because the distance L1 gradually increases toward the opening 23, resulting in that the front end portion of the first section 24 is lower in elevation than the rear end portion of the first section 24. Furthermore, because the distance L4 is longer than the distance L1, i.e. the bottom side of the connecting section 28 is lower in elevation than that of the front end of the first section 24, the toner will naturally move by gravity from the front end of the first section 24 to the connecting section 28.

When toner cartridge 12 is continuously rotated, the toner in the connecting section 28 will be moved to the longitudinal rib 30 that has a relatively higher position. Since the distance L3 gradually increases toward the opening 23, i.e. the third guiding surface 31 of the longitudinal rib 30 slopes toward the opening 23, the toner on the third guiding surface 31 will naturally move forward to the rear end of the second section 26 by gravity and subsequently move to the front end of the second section 26 due to the slope of the second guiding surface 27, and then be forced by the two guiding flaps 32 to move to the place around the opening 23.

Although the container 10 of the present invention has a simple structure, it can effectively move the toner from the rear end 21 to the front end 22 thereof. In addition, since the container 10 of the present invention has a simple structure, a mold for the container 10 is easy to manufacture, resulting in cost reduction in manufacturing. In other words, the container 10 of the present invention can improve the defect of the prior art container and achieve the objective of the present invention.

The container for toner cartridge can be made with various kinds of design on the basis of the spirit of the present invention. For example, the container can be provided with one or more guiding flaps 32. Further, the included angle between each guiding flap 32 and the axis A is not limited to the above-mentioned embodiment as long as each guiding flap 32 is not parallel to the axis A. Besides, the distance L4 can be designed shorter than or equal to both of the distance L1 and the distance L2, but the distance L4 has to be longer than the distance L3. Furthermore, the distance L3 can be designed as a fixed value instead of a variable value along the central axis A. In addition, the distance L3 can be designed longer than or equal to the distance L1 in any cross section of the first section 24 and the distance L2 in any cross section of the second section 26.

Figure 6:
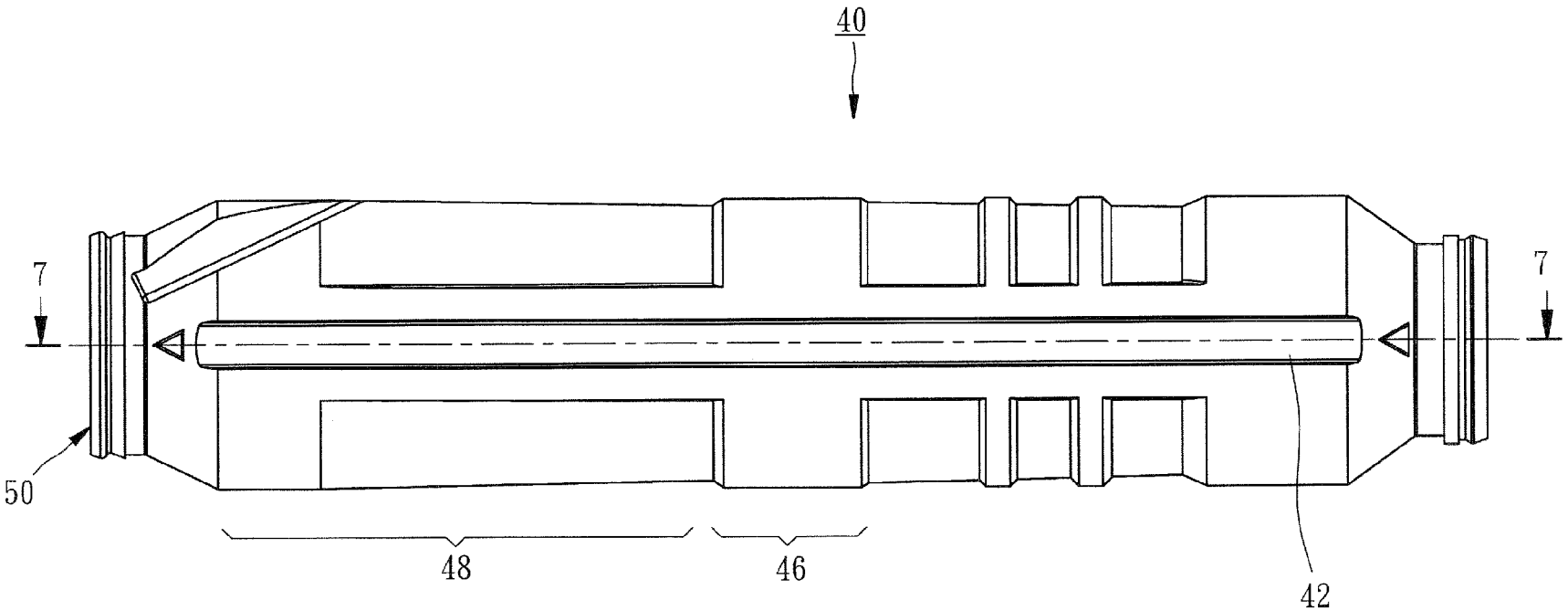
FIG. 6 is a lateral side view of a second preferred embodiment of the present invention.
Figure 7:
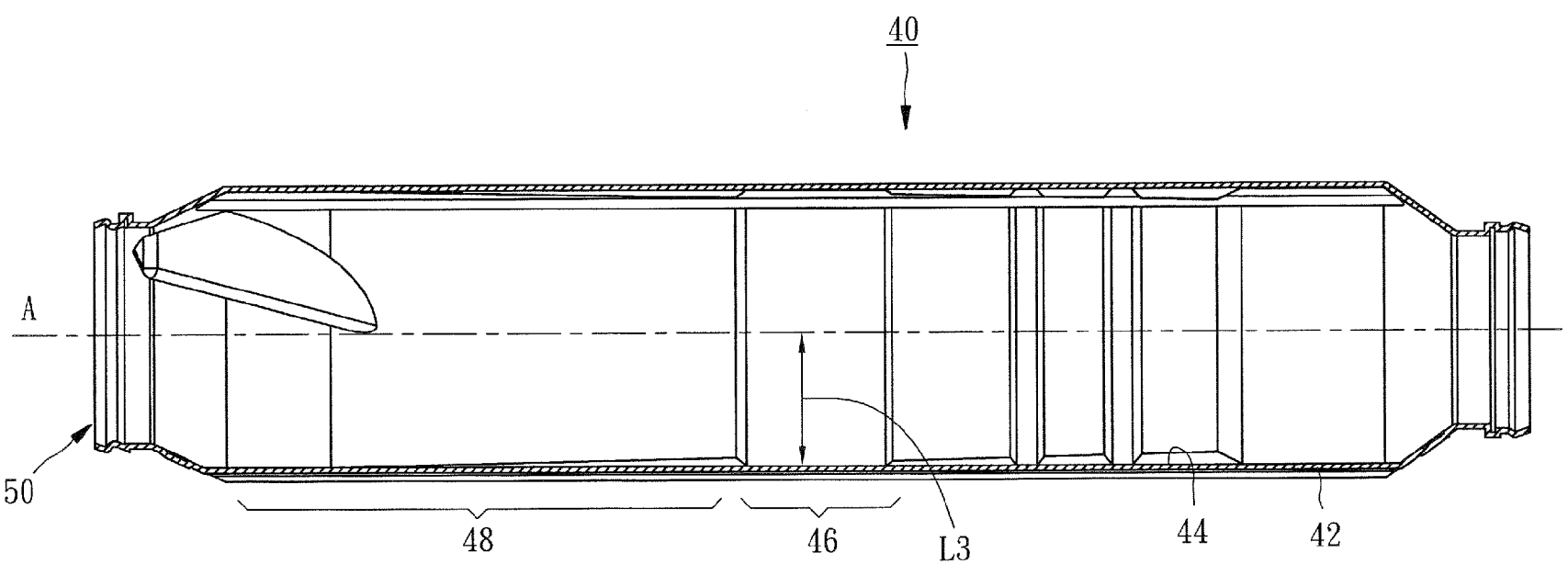
FIG. 7 is a sectional view taken along line 7-7 of FIG. 6.

As shown in FIG. 6 and FIG. 7, a container 40 in accordance with a second preferred embodiment of the present invention has basically the same structure as the first preferred embodiment of the present invention, except that the distance L3 is a constant equal to 17 mm in this embodiment. In other words, the third guiding surface 44 of the longitudinal rib 42 is parallel to the central axis A. Under this circumstance, the toner (not shown) in the connecting section 46 can arrive the longitudinal rib 42 that has a relatively higher position when the toner cartridge is rotated, and then slide forward along the third guiding surface 44 of the longitudinal rib 42. Because of a light weight of the toner particle, a part of the toner is able to fly to the second section 48 and subsequently move and arrive at the opening 50 as the toner cartridge is continuously rotated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A container for a toner cartridge, the container comprising:

an elongated hollow main body defining a central axis, the main body having a rear end and a front end with an opening;

wherein the improvement is characterized in that the main body includes a first section near the rear end, a second section near the front end, a connecting section between the first section and the second section, and a longitudinal rib protruding inwardly from an inner circumference of the main body and extending from the first section to the second section via the connecting section;

wherein the first section is provided at the inner circumference with a first guiding surface defining with the central axis a distance (L1) gradually increasing toward the opening, the second section is provided at the inner circumference with a second guiding surface defining with the central axis a distance (L2) gradually increasing toward the opening, the longitudinal rib has a third guiding surface facing the central axis and defining with the central axis a distance (L3), and the inner circumference at the connecting section defines with the central axis a distance (L4) that is longer than the distance (L3), which is defined between the third guiding surface and the central axis, at any cross section of the connecting section;

wherein the distance (L4) between the inner circumference at the connecting section and the central axis is longer than the distance (L2) between the second guiding surface and the central axis.

2. The container as claimed in claim 1, wherein the main body further includes at least one guiding flap extending from the second section to a position close to the opening in such a manner that the guiding flap is unparallel to the central axis.

3. The container as claimed in claim 2, wherein an included angle of about 30 degrees is defined between the guiding flap and the central axis.

4. The container as claimed in claim 1, wherein the distance (L4) between the inner circumference at the connecting section and the central axis is longer than the distance (L1) between the first guiding surface and the central axis.

5. The container as claimed in claim 1, wherein the distance (L3) between the third guiding surface and the central axis gradually increases toward the opening.

6. A container for a toner cartridge, the container comprising:

an elongated hollow main body defining a central axis, the main body having a rear end and a front end with an opening;

wherein the improvement is characterized in that the main body includes a first section near the rear end, a second section near the front end, a connecting section between the first section and the second section, and a longitudinal rib protruding inwardly from an inner circumference of the main body and extending from the first section to the second section via the connecting section;

wherein the first section is provided at the inner circumference with a first guiding surface defining with the central axis a distance (L1) gradually increasing toward the opening, the second section is provided at the inner circumference with a second guiding surface defining with the central axis a distance (L2) gradually increasing toward the opening, the longitudinal rib has a third guiding surface facing the central axis and defining with the central axis a distance (L3), and the inner circumference at the connecting section defines with the central axis a distance (L4) that is longer than the distance (L3), which is defined between the third guiding surface and the central axis, at any cross section of the connecting section;

wherein the distance (L4) between the inner circumference at the connecting section and the central axis is longer than the distance (L2) between the second guiding surface and the central axis;

wherein the distance (L3) between the third guiding surface and the central axis is a constant.

7. The container as claimed in claim 1, wherein the distance (L3) between the third guiding surface and the central axis is shorter than the distance (L1) between the first guiding surface and the central axis at any cross section of the first section.

8. The container as claimed in claim 1, wherein the distance (L3) between the third guiding surface and the central axis is shorter than the distance (L2) between the second guiding surface and the central axis at any cross section of the second section.

* * * * *